United States Patent [19]

Hazelett

[11] 4,116,420

[45] Sep. 26, 1978

[54] HORIZONTAL FENCE CONSTRUCTION

[75] Inventor: Earl T. Hazelett, 1940 Grand Ave., Grand Junction, Colo. 81501

[73] Assignee: Earl T. Hazelett, Grand Junction, Colo.

[21] Appl. No.: 788,804

[22] Filed: Apr. 19, 1977

[51] Int. Cl.[2] ..... E04H 17/16

[52] U.S. Cl. ..... 256/24; 256/73

[58] Field of Search ..... 256/24, 19, 73; 52/169.13, 474, 601, 297

[56] References Cited

U.S. PATENT DOCUMENTS

| | | | |
|---|---|---|---|
| 3,381,483 | 5/1968 | Huthsing, Jr. | 256/19 X |
| 3,393,896 | 7/1968 | Poland | 256/24 X |
| 3,554,495 | 1/1971 | Bach | 256/19 |
| 3,614,068 | 10/1971 | Koehl | 256/19 |
| 3,760,540 | 9/1973 | Latoria | 52/601 X |

FOREIGN PATENT DOCUMENTS

| | | | |
|---|---|---|---|
| 10,696 | 12/1932 | Australia | 256/19 |

*Primary Examiner*—Andrew V. Kundrat

*Attorney, Agent, or Firm*—John A. Robertson; Don J. Flickinger

[57] ABSTRACT

A panel fence construction having a plurality of spaced apart posts having lower ends embedded in a foundation; the posts being flat strap like members having opposite edges extending toward opposite sides of the fence; clips fixed to the opposite sides of the posts and supporting adjacent ends of superimposed panels which are superimposed in edge to edge relationship with each other; the panels being of cementatious material and having steel edge members fixed thereto; the metal edge members carried by the aforementioned clips secured to said posts; and the clips being welded to the posts and the metal edge reinforcing members being welded to the clips.

8 Claims, 6 Drawing Figures

HORIZONTAL FENCE CONSTRUCTION

BACKGROUND OF THE INVENTION

Prior art fences, such as concrete block fences, are very heavy and expensive and must be reinforced to resist high wind loading. Additionally, the construction of such fences is time consuming. Furthermore, the weight of the materials and transport thereof is a problem which requires substantial and heavy equipment. Furthermore, concrete block fences require on the job production of mortar for cementing the blocks together.

Other fence constructions, including panels, have required a rather precise fit of the panels between the related posts or column structures which has imposed some expensive labor problems upon the construction of such panel fences of the prior art.

SUMMARY OF THE INVENTION

The present invention relates to a very strong light weight and economical masonary fence constructed of precast panels having steel edge reinforcing members at opposite edges thereof. These panels are disposed in end to end relationship with each other with posts therebetween, and the posts of the invention are strap like steel members which are quite thin in a dimension longitudinally of the fence and of substantial section modulus in a direction laterally of the fence between opposite edges of said posts. Welded to said posts are clips which support the edge reinforcing members carried by the panels and the clips are welded to the posts and the edge reinforcing members of the panels are welded to the clips and the spacing of the posts is not critical since the opposite ends of the panels may be slideably relative to the posts by simply longitudinally adjusting the panels relative to the posts preliminary to the welding of the edge reinforcing members to the clips which are welded to the posts.

The specific cross section of the edge reinforcing members is generally a V-shaped cross section at the lower edge of each panel and an inverted V-shaped cross section at the upper edge of each panel and the clips which are welded to the posts are welded in cantilever direction extending from the sides of the posts so that they are conformingly engageable with the upper and lower reinforcing edge members of the panels. Whereupon, the panels may be placed on clips at the lower edges of said panels and clips of a conforming nature relative to the cross section of said edge reinforcing members may be placed against the sides of the posts in conformance with the upper edges of the panels and may be welded in place. Whereupon, the panels may then be adjustably moved such that opposite ends thereof are uniformly spaced relative to the posts and then the edge reinforcing members may be welded to the respective clips.

The cross sectional shape of the posts is such that opposite edges thereof extend toward opposite sides of the fence panels and the thickness of said posts, in a direction longitudinally of the fence, is very nominal as compared to the dimension of the posts from edge to edge thereof which extends laterally of the longitudinal direction of the fence; the posts being embedded in concrete foundation structure and having L-shaped clips welded thereto and bearing on the upper surface of the foundation; the clips being disposed at opposite sides of the posts such that a pair of said L-shaped clips provide an initial bearing and support when the posts are initially embedded in the concrete.

The aforementioned clips may be vertically spaced relative to each other so as to provide any desirable superimposed spacing of adjacent edges of the panels so as to somewhat correspond with the spacing of the ends of the panels relative to the posts.

The posts, even though they have a minimum amount of steel in them, have a substantial section modulus laterally of the plane of the fence such as to be highly resistive to wind loading, and the welding of the edge reinforcing members of the panels to the clips which are in turn welded to the posts provide for a very strong fence construction which is very simple and economical to produce and to assemble. Once the posts of the invention are embedded in a foundation in reasonably spaced relationship to each other, a welder simply proceeds welding the clips on the posts and placing the panels on the clips and welding the edge reinforcing members of the panels to the clips. Accordingly, it will be obvious that repair of the fence may require only a cutting torch so as to remove one set of clips and one panel and the panel may readily be replaced by welding the clips in place on the respective sides of the posts for supporting the new panel.

Accordingly, it is an object of the invention to provide a very simple, economical and strong fence construction composed of steel posts, cementatious panels with edge reinforcing members cast thereon, together with clips welded to the posts for supporting the edge reinforcing members and the panels.

Another object of the invention is to provide a fence which is very easy to produce and assemble on site.

Another object of the invention is to provide a fence which is very simple and easy to repair simply by utilizing conventional welding equipment.

Another object of the invention is to provide a fence having substantial strength with a minimum use of steel.

Another object of the invention is to provide a very attractive and useful fence construction.

Further objects and advantages of the invention may be apparent from the following specification, appended claims and accompanying drawings.

DESCRIPTION OF THE PREFERRED EMBODIMENTS

Figure 1:
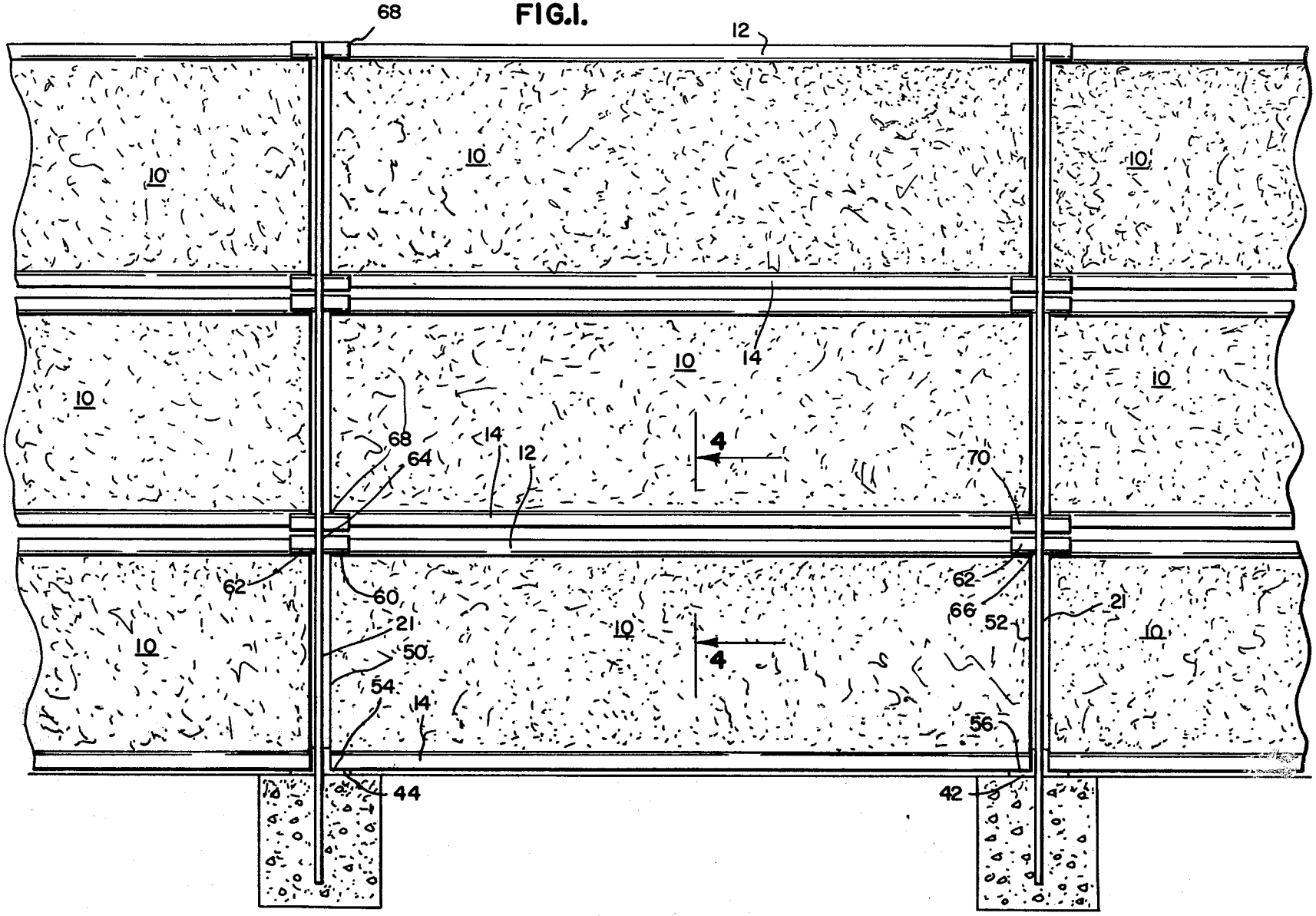
FIG. 1 is a fragmentary side elevational view of fence construction produced in accordance with the invention.
Figure 4:
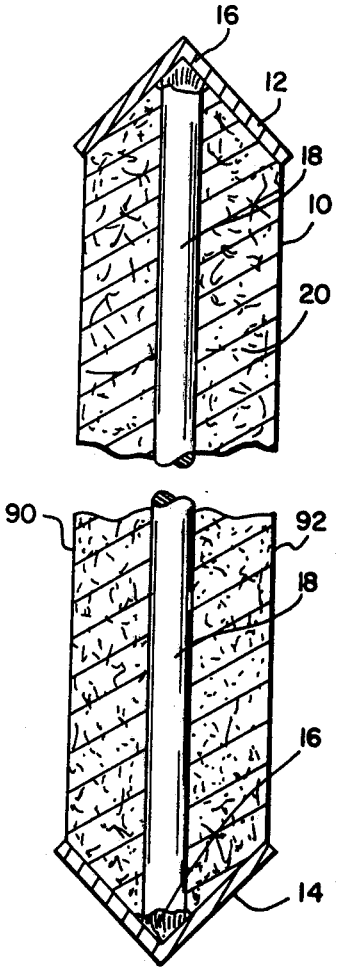
FIG. 4 is an enlarged fragmentary sectional view taken from the line 4—4 of FIG. 1.

As shown in FIG. 1 of the drawings, which is a side elevational view of a portion of the fence construction of the invention, cementatious panels 10 are provided with metal edge reinforcing members 12 and 14; the members 12 being at the upper edge of each panel, and the edge reinforcing member 14 being at the lower edge of each panel, as shown best in FIG. 4 of the drawings. The metal edge reinforcing member 12 is generally of a cross section which is an inverted V-shape and the metal edge reinforcing member 14 at the lower edge of the panel 10 is generally of a cross section which is an upright V-shape.

Welded at 16 to the inside of the edge reinforcing member 12 is a steel tension rod 18 and the opposite end of this rod 18 is welded at 16 to the edge reinforcing member 14 and the cementatious material 20 of each panel 10 is cast around the reinforcing or tension rods 18 and between the converging portions of the inverted and upright V-shaped in cross section metal edge reinforcing members 12 and 14 respectively.

These metal edge reinforcing members 12 and 14 may be conventional angle iron of various sizes, depending upon the thickness of the fence and its relative weight of panels. However, as an example, this sag line may be ⅛ inch thick and have an L-shaped cross section in which the legs are approximately 1¼ inches long.

Figure 3:
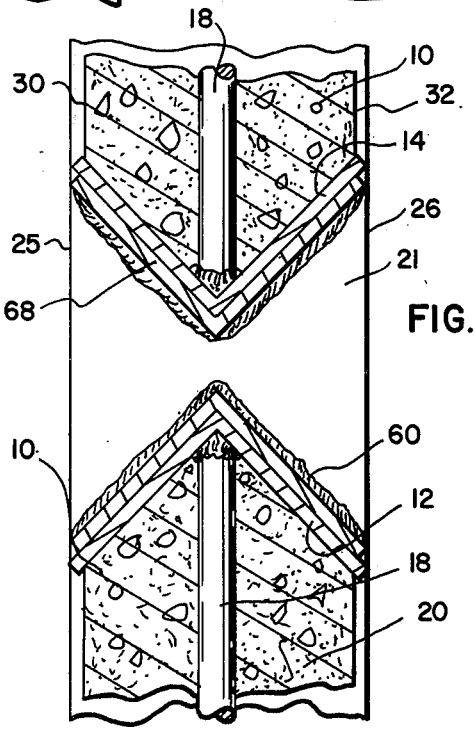
FIG. 3 is a fragmentary sectional view taken from the line 3—3 of FIG. 2.
Figure 5:
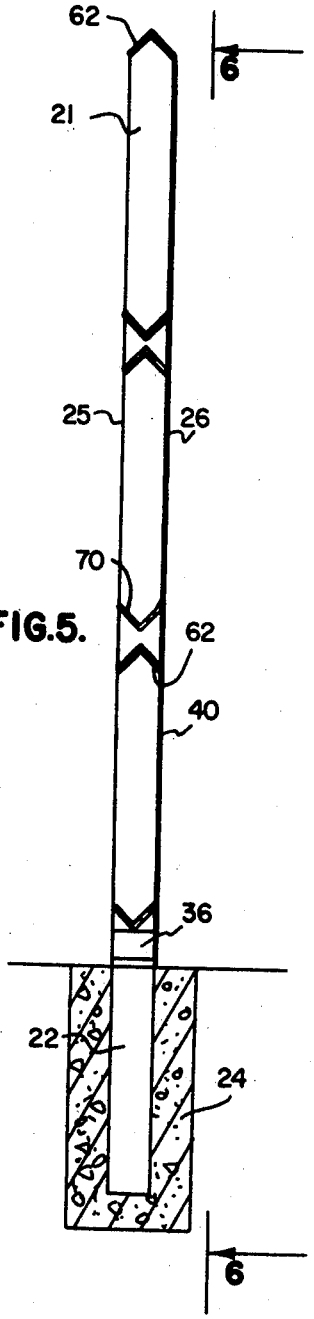
FIG. 5 is a vertical sectional view of one side of one of the posts of the fence construction of the invention with panel supporting clips secured thereto.
Figure 6:
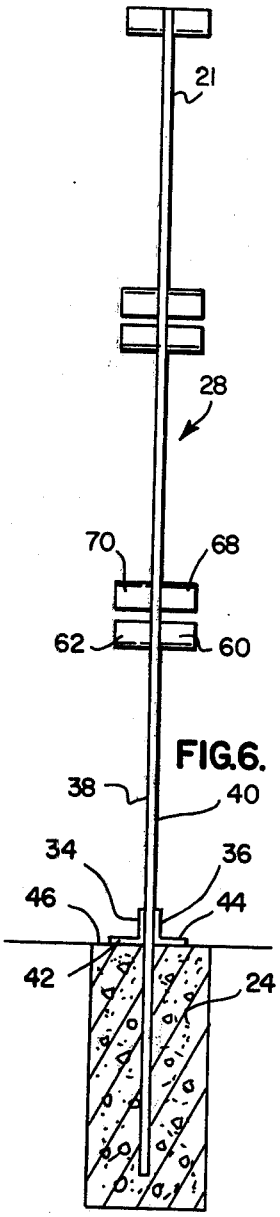
FIG. 6 is a view of the structure shown in FIG. 5 taken from line 6—6 of FIG. 5.

The steel posts, as shown best in FIGS. 5 and 6, are designated 21 and have lower ends 22 embedded in concrete foundation material 24 which is cast in the ground. These posts 21 are provided with opposite edges 25 and 26 which are spaced apart substantially 3 inches, while the thickness dimension, as indicated at 28 in FIG. 6 of the drawings, may be only ¼ of an inch. Thus, the posts are strap shaped and, as an example only, may be ¼ of an inch thick and 3 inches wide. The edges 25 and 26 extend toward opposite sides of the fence panels, as shown in FIG. 3, wherein, the panels 10 have opposite sides 30 and 32 adjacent to said opposite edges 25 and 26 of each respective post 21. Angle iron or L-shaped in cross section clips 34 and 36 are welded to opposite sides 38 and 40 of each post 21 and these clips have horizontal portions 42 and 44 which bear upon an upper surface 46 of each respective foundation structure 24.

Opposite ends 50 and 52 of the panels 10 are spaced from respective sides of the posts 21 and the lower edge reinforcing member 14 of each panel is welded at 54 near the end 50 and at 56 near the end 52 to respective legs or horizontal portions 44 and 42 respectively of the clips 36 and 34 as shown in FIG. 6 of the drawings. Thus, the panel edge reinforcing members 14 rest upon the horizontal portions 42 and 44 generally at the level of the upper portions of the foundations structures 24 and the upper reinforcing edge members 12 of the panels adjacent opposite ends 50 and 52 are held in conforming generally inverted V-shaped clips 60 and 62 which are welded at 72 and 74 to respective sides of the posts 21. It will be seen that opposite ends 50 and 52 of each panel 10 may be spaced from respective posts 21 and that the spacing of the posts 21 from each other is therefore not critical since the steel clips welded in cantilever fashion to the posts 21, namely the clips 60 and 62, may be welded to the edge reinforcing member 12 after the clips 60 and 62 have been located and welded to the posts 21.

In the illustration of FIG. 1, superimposed panels 10 is such that the metal edge reinforcing member 14 of an uppermost panel is spaced from a metal edge reinforcing member 12 of the next lower panel and steel clips 68 and 70 are welded to the posts 21 and support the lower edge reinforcing member 14 of the superimposed panel.

Figure 2:
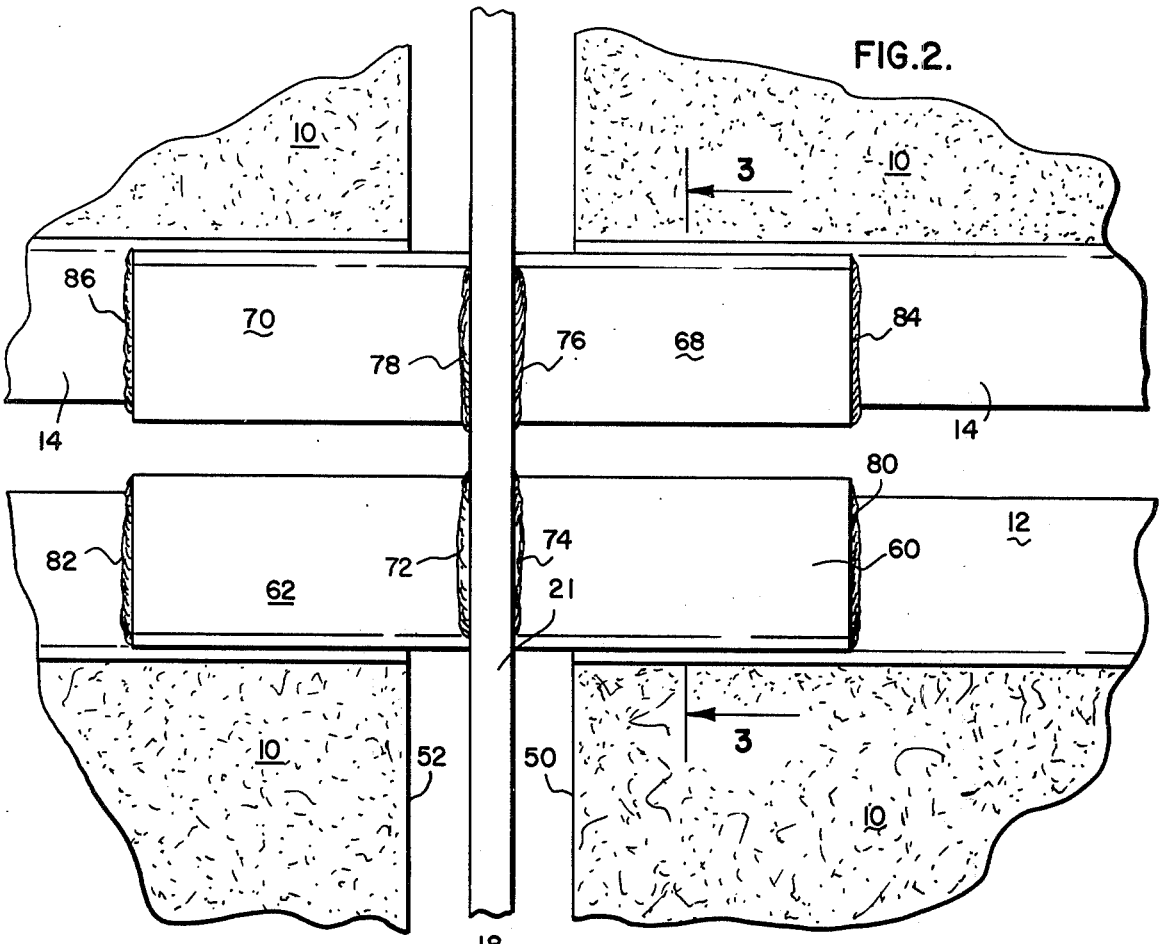
FIG. 2 is an enlarged fragmentary side elevational view similar to FIG. 1 but showing the intersection of panels supporting clips and edge reinforcing members in connection with one of the vertical posts of the invention.

This structure is shown in detail in FIGS. 2 and 3 of the drawings, wherein the inverted V-shaped in cross section clips 60 and 62 are welded to opposite sides of the respective posts 21 by means of welds 72 and 74 such that these clips extend outwardly from the posts in cantilever fashion. As shown in FIG. 3, these clips are in inverted V-shaped cross section conforming generally to the upper edge reinforcing member 12. The upright V-shaped panel edge reinforcing member 14 of the superimposed panel 10 is supported in an upright V-shaped in cross section clip 68 which is welded at 76 to one side of the post 21 while a similar clip 70 is welded at 78 to the opposite side of the post 21. The respective clips 60, 62, 68 and 70 are welded at 80, 82, 84 and 86 to respective upper and lower edge reinforcing members of the panels 10. This is done leaving the opposite ends 50 an 52 of the panels 10 is spaced relation to opposite sides of the posts 21, thus rendering the initial location and spaced relationship of the posts 21 noncritical.

It will be appreciated that with the cross section of the posts 21 in a side to side relationship with the opposite sides of the panels 10 provides for a substantial strength of the fence laterally to resist high wind loading or other forces; this being due to the relatively great section modulus of the posts 21 in a direction laterally of the fence and this thin strap like construction of the posts renders them very economical in proportion to their strength and provides convenient opposite sides for connection of the clips 60, 62, 68 and 70, all as hereinbefore described.

Opposite ends of the uppermost panel edge reinforcing member 12 of the uppermost panel 10, as shown in FIG. 5, is supported by hand welded to one of the clips 60 on one end thereof and one of the clips 62 on the other end thereof.

It will be obvious to those skilled in the art that the panels 10 cast between the edge reinforcing members 12 and 14 with the tension rods 18 embedded therein may be quite thin between opposite sides 90 and 92 thereof, as shown in FIG. 4 of the drawings. As for example, these panels may be as thin as one to 1½ inches. Obviously, the panels may be made thicker in accordance with the construction hereinbefore described.

It will be obvious to those skilled in the art that various modifications may be resorted to without departing from the spirit of the invention.

I claim:

1. In a panel fence construction: a plurality of spaced apart posts each having lower ends and opposite sides; a foundation in which a lower end of each post is fixed; a flat horizontally elongated panel disposed between said posts; said panel having opposite sides disposed vertically; said panel having upper and lower edges and opposite ends; said opposite ends disposed vertically adjacent to said opposite sides of said posts; said upper and lower edges of said panel having steel generally L-shaped in cross section edge reinforcing members fixed thereto; said posts being flat steel members having opposite edges directed generally toward opposite sides of said panels; said posts having opposite sides facing respective ends of said panels; the thickness dimension of said posts between opposite sides thereof being only a fraction of the dimension of said posts between said opposite edges thereof; steel clips fixed to said sides of said posts and fixed to said steel edge reinforcing members of said panels.

2. The invention as defined in claim 1, wherein: said L-shaped in cross section edge reinforcing members, at said upper edge of said panels, being disposed in an inverted generally U-shaped position; said L-shaped in cross section edge reinforcing members at said lower edge of said panels being disposed in an upright generally V-shaped position.

3. The invention as defined in claim 2, wherein: said steel clips being L-shaped and conforming to said inverted V-shaped and upright V-shaped positions; said clips being in generally contiguous relation to said edge reinforcing members at opposite ends of said panels and fixed to said posts in cantilever relationship thereto.

4. The invention as defined in claim 3, wherein: said posts, edge reinforcing members and said clips all being of steel; said clips welded to said posts; said edge reinforcing members being welded to said clips.

5. The invention as defined in claim 3, wherein: a plurality of said panels are disposed in end to end relationship with said posts supporting opposite ends of said panels such that one end of one of said panels is supported by respective ones of said clips at each of said opposite sides of said posts.

6. The invention as defined in claim 3, wherein: said posts are spaced apart a distance greater than the distance between opposite ends of said panels; said reinforcing edge members fixed to said clips in positions such that opposite ends of said panels are spaced from aid posts.

7. The invention as defined in claim 3, wherein: said clips are spaced from each other in a vertical direction on said posts such that said panels, at their adjacent horizontal edges, are spaced apart.

8. In a panel fence construction, a plurality of spaced apart posts each having lower ends and opposite sides; a foundation in which a lower end of each post is fixed; a plurality of flat horizontally elongated panel disposed between adjacent posts; said panels having opposite sides disposed vertically; said panels having upper and lower edges and opposite ends; said opposite ends being disposed vertically adjacent to said opposite sides of said posts; said upper and lower edges of said panels having steel edge reinforcing members fixed thereto; said posts being flat steel members having opposte edges directed generally toward opposite sides of said panels; said posts having opposite sides facing respective ends of said panels; the thickness dimension of said posts, between opposite sides thereof, being only a fraction of the dimension of said posts between opposite edges thereof; steel clips fixed to said sides of said posts and fixed to said steel edge reinforcing members of said panels; L-shaped base clips fixed to said posts above said foundation, each of said base clips having two portions extending at right angles to each other; one of said portions resting on said foundation; the other of said portions being fixed to one side of a post.

* * * * *